US009882303B1

(12) United States Patent
Chalas et al.

(10) Patent No.: US 9,882,303 B1
(45) Date of Patent: Jan. 30, 2018

(54) MODULAR ELECTRICAL CONNECTOR AND METHOD OF ASSEMBLY

(71) Applicant: TE CONNECTIVITY CORPORATION, Berwyn, PA (US)

(72) Inventors: Guadalupe Chalas, Harrisburg, PA (US); John Wesley Hall, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/605,383

(22) Filed: May 25, 2017

(51) Int. Cl.
*H01R 13/514* (2006.01)
*H01R 13/631* (2006.01)
*H01R 13/424* (2006.01)
*H01R 43/20* (2006.01)

(52) U.S. Cl.
CPC ..... *H01R 13/514* (2013.01); *H01R 13/424* (2013.01); *H01R 13/631* (2013.01); *H01R 43/20* (2013.01)

(58) Field of Classification Search
CPC .. H01R 13/424; H01R 13/514; H01R 13/631; H01R 9/2408; H01R 33/76; H01R 43/20
USPC ..... 439/374, 686, 695, 701, 712
See application file for complete search history.

(56) References Cited

U.S. PATENT DOCUMENTS 5,085,592 A * 2/1992 Sekiguchi ..... H01R 13/7031 200/51.1
5,643,010 A * 7/1997 Wu ..... H01R 13/436 439/598
6,033,258 A * 3/2000 Huang ..... H01R 13/514 439/541.5
6,077,092 A * 6/2000 Chiu ..... H01R 12/724 439/79
6,358,098 B1 * 3/2002 Wakata ..... H01R 13/4223 439/701
6,702,623 B2 * 3/2004 Fukuda ..... H01R 4/2454 439/595
6,790,054 B1 * 9/2004 Boonsue ..... H01R 12/721 439/79
7,588,463 B2 * 9/2009 Yamada ..... H01R 13/514 439/108
7,963,799 B1 * 6/2011 Lee ..... H01R 12/724 439/541.5
8,292,659 B2 * 10/2012 Tuin ..... H01R 23/688 439/540.1
(Continued)

*Primary Examiner* — Tulsidas C Patel
*Assistant Examiner* — Travis Chambers

(57) ABSTRACT

A modular electrical connector assembly and method of assembly. The modular electrical connector assembly includes a first housing, a second housing and a third housing. The first housing has first electrical contacts inserted therein. The first housing has first contact isolation walls positioned between adjacent first electrical contacts. The second housing has second electrical contacts inserted therein. The second housing has second contact isolation walls positioned between adjacent second electrical contacts. The third housing has a first opening for positioning the first housing therein and a second opening for positioning the second housing therein. The third housing has third contact isolation walls. Respective first contact isolation walls, second contact isolation walls and third contact isolation walls align to provide separation between adjacent first electrical contacts and separation between adjacent second electrical contacts.

15 Claims, 4 Drawing Sheets

(56) References Cited

U.S. PATENT DOCUMENTS

| | | | | |
|---|---|---|---|---|
| 9,362,693 | B2 * | 6/2016 | Martin | H01R 24/66 |
| 2010/0221959 | A1 * | 9/2010 | Pan | H01R 13/514 439/701 |
| 2010/0267256 | A1 * | 10/2010 | Eriguchi | H01R 12/724 439/83 |

* cited by examiner

MODULAR ELECTRICAL CONNECTOR AND METHOD OF ASSEMBLY

FIELD OF THE INVENTION

The invention is directed to a modular electrical connector assembly and method of assembly. In particular, the invention is directed to a modular electrical connector assembly that allows for the bending of the contacts and insertion of the contacts into the modular electrical connector assembly utilizing convention tooling.

BACKGROUND OF THE INVENTION

Connectors generally have a large number of conductive contacts aligned in a dielectric housing thereof. Such connector must be designed to fulfill requirements of proper alignment, engagement and coplanarity of the contacts assembled in the housing. One way to assemble contacts of conventional connectors is to insert the contacts into contact receiving passageways of the housing and bend the tails of the contacts to properly position the tails for mating to a mating circuit board. However, achieving reliability of all the contacts assembled in the housing is difficult due to space requirements and inability for conventional tooling to interact with the contacts to facilitate the bending thereof. Another way to assemble contacts of conventional connectors is to pre-bend the contacts and insert the pre-bent contacts into contact receiving passageways. However, this is not practical for all contact configurations as the pressing force acting on the contacts may be large, causing the contacts to deform.

Hence, an improved electrical connector assembly is desired to overcome the disadvantages of the prior art. It would, therefore, be beneficial to provide a modular electrical connector assembly and method which allows contact to be bent and inserted into the housing without damage to the contacts. In addition, it would be beneficial to allow for the contacts to be bent with the use of conventional tooling. Hence, an improved electrical connector is desired to overcome the disadvantages of the prior art.

SUMMARY OF THE INVENTION

An embodiment is directed to a modular electrical connector assembly which includes a first housing, a second housing and a third housing. The first housing has first electrical contacts inserted therein. The first housing has first contact isolation walls positioned between adjacent first electrical contacts. The second housing has second electrical contacts inserted therein. The second housing has second contact isolation walls positioned between adjacent second electrical contacts. The third housing has a first opening for positioning the first housing therein and a second opening for positioning the second housing therein. The third housing has third contact isolation walls. Respective first contact isolation walls, second contact isolation walls and third contact isolation walls align to provide separation between adjacent first electrical contacts and separation between adjacent second electrical contacts.

An embodiment is directed to a modular electrical connector assembly which includes a first housing, a second housing and a third housing. The first housing has first electrical contacts inserted therein. The first housing has first electrical contacts inserted therein. The second housing has second electrical contacts inserted therein. The third housing has a first opening for positioning the first housing therein and a second opening for positioning the second housing therein. First projections extend from a contact receiving end of the first housing in a direction away from a mating end of the first housing. The first projections provide a surface which allows an operator or automated machinery to engage the first housing and insert the first housing in the first opening of the third housing. The second projections extend from a contact receiving end of the second housing in a direction away from a mating end of the second housing. The second projections provide a surface which allows an operator or automated machinery to engage the second housing and insert the second housing in the second opening of the third housing.

An embodiment is directed to a method of assembling a modular electrical connector assembly. The method includes: inserting first contacts into a first housing; bending the first contacts; inserting second contacts into a second housing; bending the second contacts; inserting the second housing with the bent second contacts into a second housing receiving opening of a third housing; securing the second housing in the second housing receiving opening of the third housing; inserting the first housing with the bent first contacts into a first housing receiving opening of the third housing; and securing the first housing in the first housing receiving opening of the third housing.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 2:
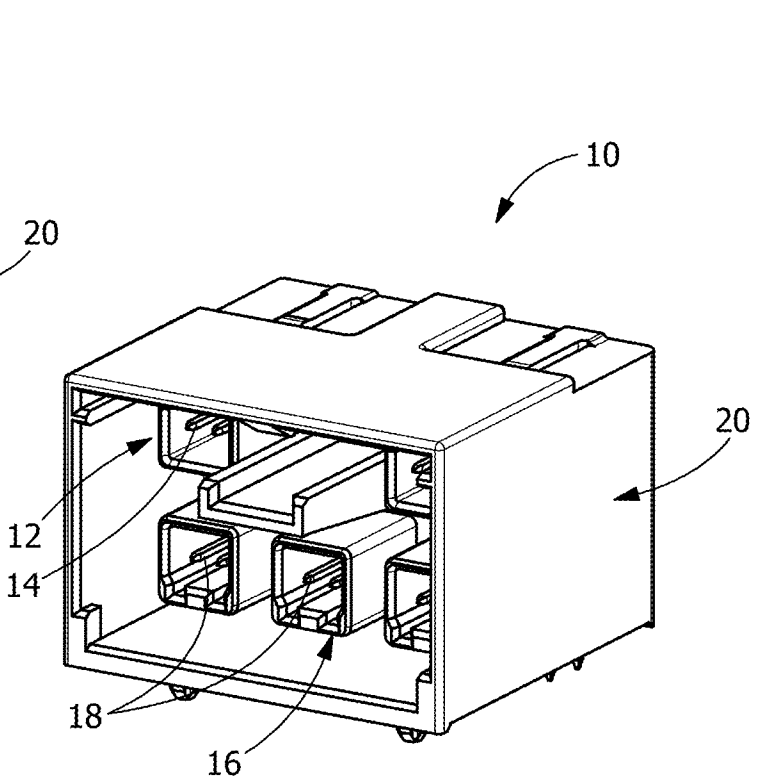
FIG. 2 is a front perspective view of the modular electrical connector assembly of FIG. 1.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As best shown in FIGS. 1 through 4, a modular electrical connector assembly 10 includes a first housing 12 with first electrical contacts 14 positioned therein, a second housing 16 with second electrical contacts 18 positioned therein, and a third housing 20 which receives the first housing 12 and second housing 16 therein. The modularity of the modular electrical connector assembly 10 and the use of the first housing 12, second housing 16 and third housing 20 allows the modular electrical connector assembly 10 to be assembled using traditional tooling. The use of the first housing 12 allows the first contacts 14 to be inserted into the first housing 12 and bent to the proper configuration prior to the first housing 12 and first contacts 14 being inserted into the third housing 20. Similarly, the use of the second housing 18 allows the second contacts 18 to be inserted into the second housing 16 and bent to the proper configuration prior to the second housing 16 and second contacts 18 being inserted into the third housing 20.

Figure 5:
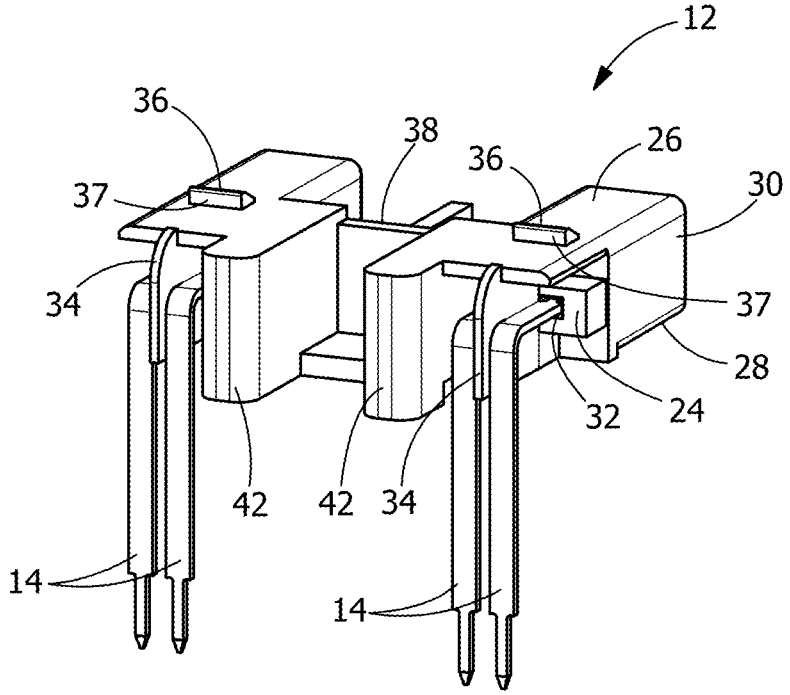
FIG. 5 is a back perspective view of an illustrative first housing of the modular electrical connector assembly.
Figure 6:
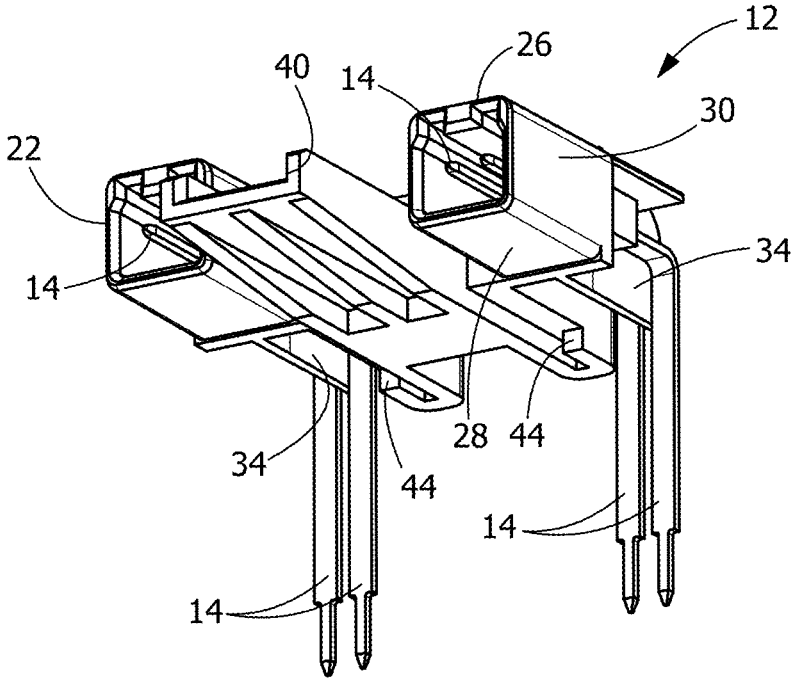
FIG. 6 is a front perspective view of the first housing of FIG. 5.

As best shown in FIGS. 5 and 6, the illustrative embodiment of the first housing 12 has a mating end 22 and a contact receiving end 24. The mating end 22 is configured to mate with a mating connector (not shown). A top wall 26 and an oppositely facing bottom wall 28 extend between the mating end 22 and the contact receiving end 24. Sidewalls 30 extend between the mating end 22 and the contact receiving end 24 and extend between the top wall 26 and the bottom wall 28.

Contact receiving passages 32 extend from proximate the contact receiving end 24 to proximate the mating end 22. Contact isolation and spacing walls or partitions 34 are positioned proximate the contact receiving end 24 and extend from the top wall 26 in a direction toward the bottom wall 28. The contact isolation and spacing walls or partitions 34 extend between the contacts 14 inserted in the contact receiving passages 32 to maintain separation between adjacent contacts 14.

Locking projections 36, having locking shoulders 37, extend from the top wall 26 to cooperate with the third housing 20 to retain the first housing 12 in position relative to the third housing 20. A positioning recess 38 is provided in the top wall 26. The positioning recess 38 cooperates with the third housing 20 to properly position the first housing 12 in the third housing 20.

In the embodiment shown, a keying member 40 extends beyond the mating end 22. The keying member 40 cooperates with the mating connector (not shown) to prevent the mating of an improper mating connector to the modular electrical connector assembly 10.

Projections 42 extend from the contact receiving end 24 in a direction away from the mating end 22. The projections 42 provide protection for shielding plates (not shown) and decrease the possibility of the contacts 14, 18 engaging the shielding plates. In addition, the projections 42 may provide a surface which allows an operator or automated machinery to engage the first housing 12 and insert the first housing 12 into the third housing 20. Over insertion surfaces 44 are positioned proximate projections 42. The over insertion surfaces 44 cooperate with the third housing 20 to prevent the over insertion of the first housing 12 into the third housing 20.

Figure 7:
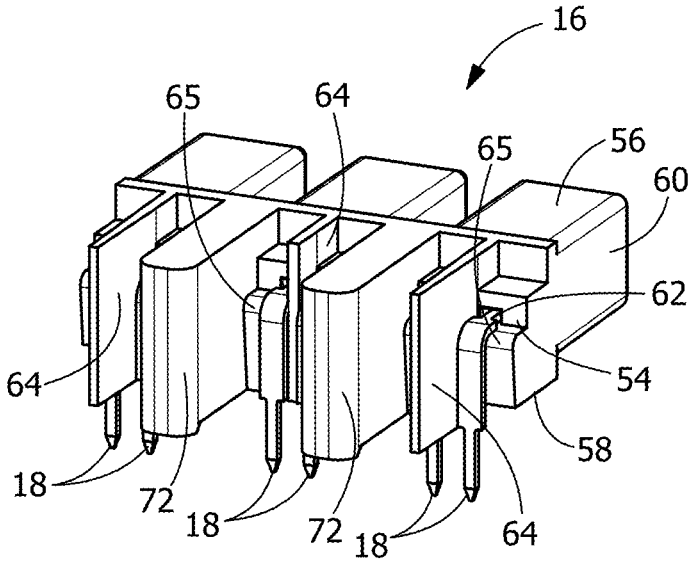
FIG. 7 is a back perspective view of an illustrative second housing of the modular electrical connector assembly.
Figure 8:
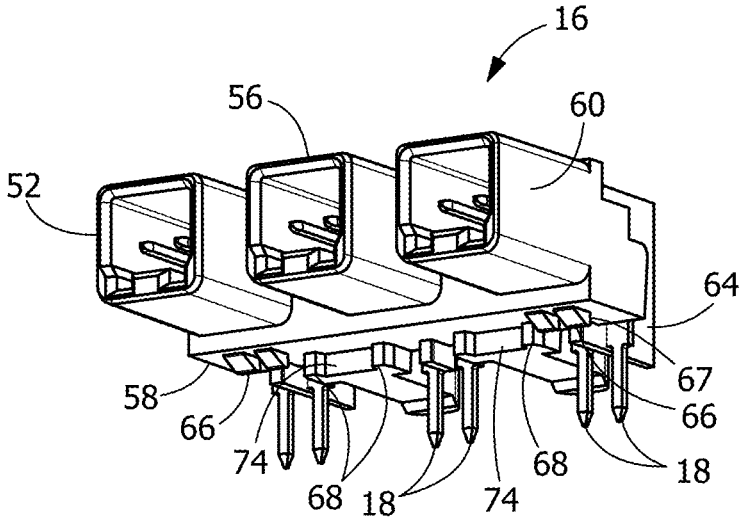
FIG. 8 is a front perspective view of the second housing of FIG. 7.

As best shown in FIGS. 7 and 8, the illustrative embodiment of the second housing 16 has a mating end 52 and a contact receiving end 54. The mating end 52 is configured to mate with a mating connector (not shown). A top wall 56 and an oppositely facing bottom wall 58 extend between the mating end 52 and the contact receiving end 54. Sidewalls 60 extend between the mating end 52 and the contact receiving end 54 and extend between the top wall 56 and the bottom wall 58.

Contact receiving passages 62 extend from proximate the contact receiving end 54 to proximate the mating end 52. Contact isolation and spacing walls or partitions 64 are positioned proximate the contact receiving end 54 and extend from the top wall 56 in a direction toward the bottom wall 58. The contact isolation and spacing walls or partitions 64 extend between the contacts 18 inserted in the contact receiving passages 62 to maintain separation between adjacent contacts 18.

Contact bending surfaces 65 are provided at the mating end 52 proximate the contact receiving passages 62. The contact bending surfaces 65 have an arcuate configuration to allow the contacts 18 to be bent, as will be more fully described.

Locking projections 66, having locking shoulders 67, extend from the bottom wall 58 to cooperate with the third housing 20 to retain the second housing 16 in position relative to the third housing 20. Positioning projections 68 extend from the bottom wall 58. The positioning projections 68 cooperate with the third housing 20 to properly position the second housing 16 in the third housing 20.

Projections 72 extends from the contact receiving end 54 in a direction away from the mating end 52. The projections 72 provide protection for shielding plates (not shown) and decrease the possibility of the contacts 14, 18 engaging the shielding plates. In addition, the projections may provide a surface which allows an operator or automated machinery to engage the second housing 16 and insert the second housing 16 into the third housing 20. Over insertion surfaces 74 are positioned proximate projections 72. The over insertion surfaces 74 cooperate with the third housing 20 to prevent the over insertion of the second housing 16 into the third housing 20.

Figure 4:
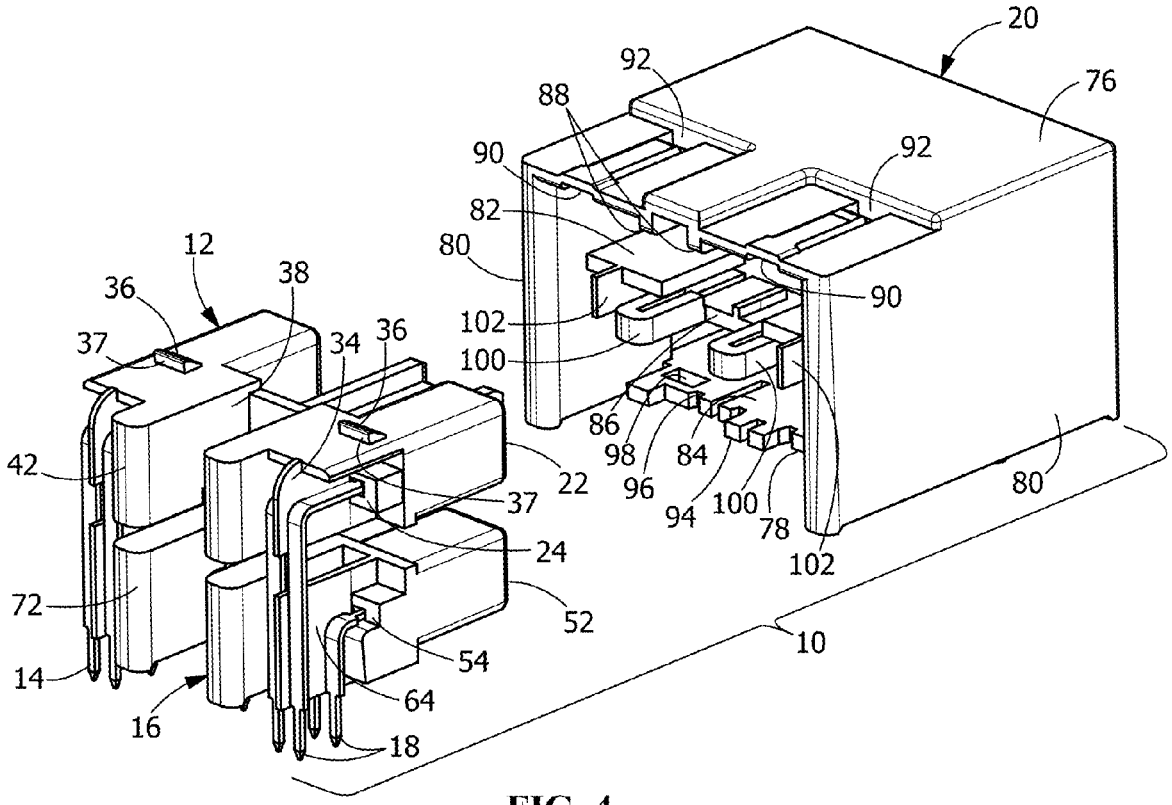
FIG. 4 is an exploded perspective view of the modular electrical connector assembly of FIG. 1 with the first housing and the second housing exploded from the third housing.

As best shown in FIG. 4, the third housing 20 has a top wall 76, a bottom wall 78 and sidewalls 80 which extend between the top wall 76 and the bottom wall 78. A first housing receiving opening 82 is provided proximate the top wall 76. A second housing receiving opening 84 is provided proximate the bottom wall 78. A partition or dividing wall 86 is positioned between the first housing receiving opening 82 and the second housing receiving opening 84. Circuit board alignment posts 87 (FIG. 3) extend from the bottom wall 78. Various embodiments of the third housing 20 may also include shielding (not shown) to better isolate the contacts 14, 18.

Alignment projections 88 extend from the top wall 76 in a direction toward the dividing wall 86. The projections 88 cooperate with the positioning recess 38 of the first housing 12 to properly position the first housing 12 in the first housing receiving opening 82 of the third housing 20. Locking projection receiving slots 90 and locking projection receiving openings 92 are positioned in the top wall 76. As the first housing 12 is inserted into the first housing receiving opening 82, the locking projections 36 of the first housing 12 are positioned and move in locking projection receiving slots 90. When the first housing 12 is fully inserted into the first housing receiving opening 82, the locking projections 36 of the first housing 12 are moved into the locking projection receiving openings 92. In this position, the locking shoulders 37 of the locking projections 36 cooperate with walls of the locking projection receiving openings 92 to retain the first housing 12 in the first housing receiving opening 82 of the third housing 20 to prevent the unwanted removal of the first housing 12.

Alignment projections 94 and alignment recesses 96 are provided on the bottom wall 78. The projections 94 and recesses 96 cooperate with the positioning recesses 68 of the second housing 16 to properly position the second housing 16 in the second housing receiving opening 84 of the third housing 20. Locking projection receiving openings 98 are positioned in the bottom wall 78. When the second housing 16 is fully inserted into the second housing receiving opening 84, the locking projections 66 of the second housing 16 are moved into the locking projection receiving openings 98. In this position, the locking shoulders 67 of the locking projections 66 cooperate with walls of the locking projection receiving openings 98 to retain the second housing 16 in the second housing receiving opening 84 of the third housing 20 to prevent the unwanted removal of the second housing 16.

Figure 1:
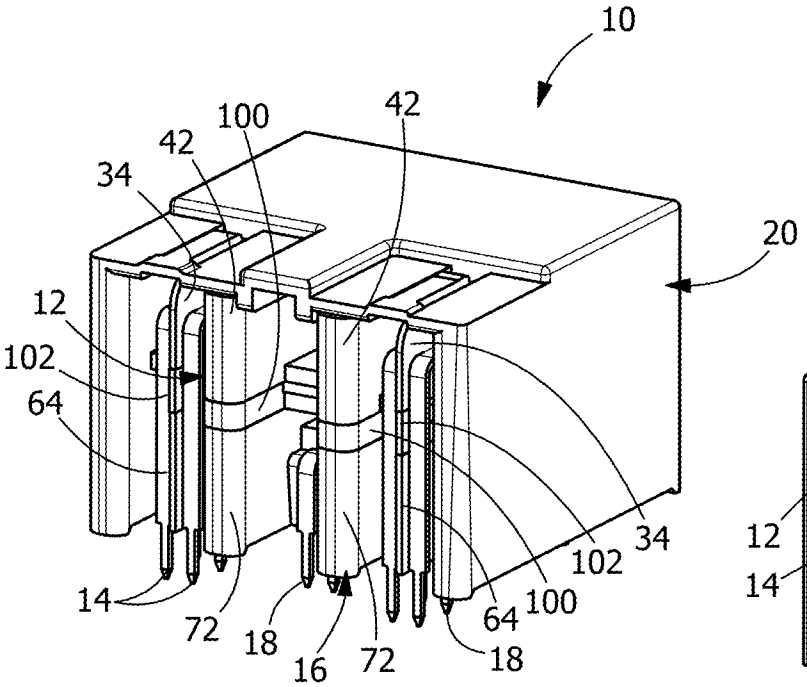
FIG. 1 is a back perspective view of an illustrative modular electrical connector assembly of the present invention with a first housing and a second housing inserted into a third housing.
Figure 3:
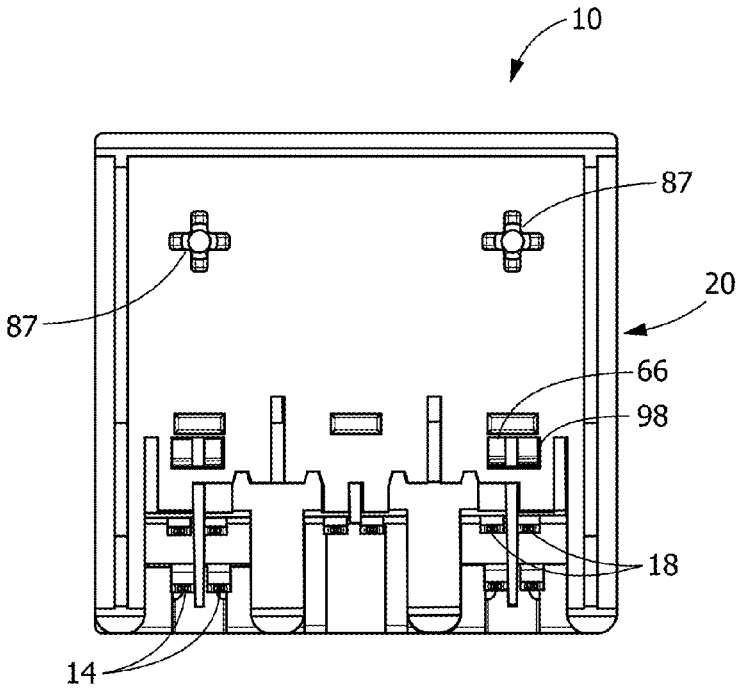
FIG. 3 is a bottom view of the modular electrical connector assembly of FIG. 1.

Projections 100 extend from the back of the dividing wall 86. The projections 100 align with projections 42 of the first housing 14 and projections 72 of the second housing 16 to from a continuous member when the first housing 12 and second housing 16 are properly inserted into the third housing 20, as best shown in FIG. 1.

Contact isolation and spacing walls or partitions 102 extend from the back of the dividing wall 86. When the first housing 12 and second housing 16 are properly inserted into the third housing 20, as best shown in FIG. 1, the contact isolation and spacing walls or partitions 102 are positioned to align with the contact isolation and spacing walls or partitions 34 of the first housing 12 and the contact isolation and spacing walls or partitions 64 of the second housing 16 to provide a continuous wall or partition which separates or isolates respective contacts 14 and respective contacts 18.

The modular electrical connector assembly 10 allows for the contacts 14, 18 to be inserted and bent to the proper configuration, even when the size and configuration of the modular electrical connector assembly 10 must be optimized.

The method of assembling the modular electrical connector assembly, includes: inserting first contacts into a first housing; bending the first contacts; inserting second contacts into a second housing; bending the second contacts; inserting the second housing with the bent second contacts into a second housing receiving opening of a third housing; securing the second housing in the second housing receiving opening of the third housing; inserting the first housing with the bent first contacts into a first housing receiving opening of the third housing; and securing the first housing in the first housing receiving opening of the third housing.

The method may include isolating respective first contacts from adjacent first contacts and isolating respective second contacts from adjacent second contacts.

The method may include bending the second contacts about contact bending surfaces provided proximate contact receiving passages of the second housing.

More particularly, the first connector housing 12 is molded and the contacts 14 are inserted into the contact receiving passages 32. The contacts 14 have a generally planar configuration when they are inserted into the contact receiving passages 32. In alternative embodiments, the first connector housing 12 may be overmolded over the contacts 14.

With the contacts 14 properly positioned in the first connector housing 14, the tails of the contacts 14 are bent to the desired position. As this occurs, support tooling (not shown) supports a portion of the contacts 14 while bending tooling (not shown) engages and bends the tails to the desired position. The process of bending contacts is known in the industry.

The second connector housing 16 is molded and the contacts 18 are inserted into the contact receiving passages 62. The contacts 18 have a generally planar configuration when they are inserted into the contact receiving passages 62. In alternative embodiments, the second connector housing 16 may be overmolded over the contacts 18.

With the contacts 18 properly positioned in the second connector housing 16, the tails of the contacts 18 are bent to the desired position. As this occurs, contact bending surfaces 65 supports a portion of the contacts 18 while bending tooling (not shown) engages and bends the tails to the desired position. The process of bending contacts is known in the industry.

It is important to note that the contacts 14, 18 are high impedance contacts. Therefore, the contacts 14, 18 cannot contain shoulders which would enable the contacts 14, 18 to be inserted into the contact receiving passages 32, 62 after they are bent. Therefore, the contacts 14, 18 must be bent after insertion into the contact receiving passages 32, 62.

With the contacts 18 properly positioned and configured in the second housing 16, the second housing 16 is inserted into the second housing receiving opening 84. As this occurs, force is applied to the projections 72 of the second housing 16 causing the positioning projections 68 of the second housing 16 cooperate with the alignment projections 94 and alignment recesses 96 to align the second housing 16 in the second housing receiving opening 84. In addition, the locking projections 66 engage the locking projection receiving openings 98 to retain the second housing 16 in the second housing receiving opening 84.

With the contacts 14 properly positioned and configured in the first housing 12, the first housing 12 is inserted into the first housing receiving opening 82. As this occurs, force is applied to the projections 42 of the first housing 12 causing the positioning projections 88 of the third housing 20 cooperate with the positioning recess 38 of the first housing 12 to align the first housing 12 in the first housing receiving opening 82. In addition, the locking projections 36 engage the locking projection receiving openings 92 to retain the first housing 12 in the first housing receiving opening 82.

As previously described, when the first housing 12 and second housing 16 are properly inserted into the third housing 20, the contact isolation and spacing walls or partitions 34 of the first housing 12, the contact isolation and spacing walls or partitions 64 of the second housing 16, and the contact isolation and spacing walls or partitions 102 are positioned to align with each other to provide a continuous wall or partition which separates or isolates respective contacts 14 and respective contacts 18.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A modular electrical connector assembly comprising:

a first housing having first electrical contacts inserted therein, the first housing having first contact isolation walls positioned between adjacent first electrical contacts;

a second housing having second electrical contacts inserted therein, the second housing having second contact isolation walls positioned between adjacent second electrical contacts;

a third housing having a first opening for positioning the first housing therein and a second opening for positioning the second housing therein, the third housing having third contact isolation walls;

respective first contact isolation walls, second contact isolation walls and third contact isolation walls align to provide separation between adjacent first electrical contacts and separation between adjacent second electrical contacts.

2. The modular electrical connector assembly of claim 1, wherein the third housing has a wall which extends between the first opening and the second opening.

3. The modular electrical connector assembly of claim 1, wherein a keying member extends beyond a mating end of the first housing, the keying member cooperates with the mating connector.

4. The modular electrical connector assembly of claim 1, wherein contact bending surfaces are provided proximate contact receiving passages of the second housing, the contact bending surfaces have arcuate configurations to allow the second electrical contacts to be bent thereabout.

5. The modular electrical connector assembly of claim 1, wherein the first contact isolation walls are positioned proximate a contact receiving end of the first housing and extend from a top wall of the first housing in a direction toward the bottom wall of the first housing, the first contact isolation walls extend between respective first electrical contacts to maintain separation between the respective first electrical contacts.

6. The modular electrical connector assembly of claim 5, wherein the second contact isolation walls are positioned proximate a contact receiving end of the second housing and extend from the top wall of the second housing in a direction toward the bottom wall of the second housing, the second contact isolation walls extend between respective second electrical contacts to maintain separation between the respective second electrical contacts.

7. The modular electrical connector assembly of claim 1, wherein the first housing has first locking projections which cooperate with the third housing to retain the first housing in position in the first opening of the third housing.

8. The modular electrical connector assembly of claim 7, wherein the second housing has second locking projections which cooperate with the third housing to retain the second housing in position in the second opening of the third housing.

9. The modular electrical connector assembly of claim 1, wherein a positioning recess is provided in the first housing, the positioning recess cooperates with the third housing to properly position the first housing in the first opening of the third housing.

10. The modular electrical connector assembly of claim 9, wherein positioning projections are provided on the second housing, the positioning projections cooperate with the third housing to properly position the second housing in the second opening of the third housing.

11. The modular electrical connector assembly of claim 1, wherein first projections extend from a contact receiving end of the first housing in a direction away from a mating end of the first housing, the first projections provide a surface which allows an operator or automated machinery to engage the first housing and insert the first housing in the first opening of the third housing.

12. The modular electrical connector assembly of claim 11, wherein second projections extend from a contact receiving end of the second housing in a direction away from a mating end of the second housing, the second projections provide a surface which allows an operator or automated machinery to engage the second housing and insert the second housing in the second opening of the third housing.

13. A modular electrical connector assembly comprising:

a first housing having first electrical contacts inserted therein;

a second housing having second electrical contacts inserted therein;

a third housing having a first opening for positioning the first housing therein and a second opening for positioning the second housing therein;

first projections extend from a contact receiving end of the first housing in a direction away from a mating end of the first housing, the first projections provide a surface which allows an operator or automated machinery to engage the first housing and insert the first housing in the first opening of the third housing;

second projections extend from a contact receiving end of the second housing in a direction away from a mating end of the second housing, the second projections provide a surface which allows an operator or automated machinery to engage the second housing and insert the second housing in the second opening of the third housing;

contact bending surfaces are provided proximate contact receiving passages of the second housing, the contact bending surfaces have arcuate configurations to allow the second electrical contacts to be bent thereabout.

14. The modular electrical connector assembly of claim 13, wherein first contact isolation and spacing walls are positioned proximate a contact receiving end of the first housing and extend from a top wall of the first housing in a direction toward the bottom wall of the first housing, the first contact isolation and spacing walls extend between respective first electrical contacts to maintain separation between the respective first electrical contacts.

15. The modular electrical connector assembly of claim 13, wherein second contact isolation and spacing walls are positioned proximate a contact receiving end of the second housing and extend from the top wall of the second housing in a direction toward the bottom wall of the second housing, the second contact isolation and spacing walls extend between respective second electrical contacts to maintain separation between the respective second electrical contacts.

* * * * *